US010433706B2

(12) United States Patent
Mian

(10) Patent No.: US 10,433,706 B2
(45) Date of Patent: Oct. 8, 2019

(54) LINEAR RECIPROCATING DEVICE

(71) Applicant: CONTINUUM INNOVATIONS LIMITED, Croydon, Surrey (GB)

(72) Inventor: Abid Mian, Croydon (GB)

(73) Assignee: CONTINUUM INNOVATIONS LIMITED, Croydon, Surrey (GB)

( * ) Notice: Subject to any disclaimer, the term of this patent is extended or adjusted under 35 U.S.C. 154(b) by 496 days.

(21) Appl. No.: 15/146,341

(22) Filed: May 4, 2016

(65) Prior Publication Data

US 2016/0316994 A1 Nov. 3, 2016

Related U.S. Application Data

(63) Continuation-in-part of application No. PCT/GB2014/000446, filed on Nov. 5, 2014.

(30) Foreign Application Priority Data

Nov. 6, 2013 (GB) ..... 1319594.6

(51) Int. Cl.
*A47L 23/06* (2006.01)
*A46B 13/02* (2006.01)
(Continued)

(52) U.S. Cl.
CPC ..... *A47L 23/06* (2013.01); *A46B 5/0095* (2013.01); *A46B 13/02* (2013.01); *B24B 23/04* (2013.01);
(Continued)

(58) Field of Classification Search
CPC ..... A46B 13/02; A46B 5/0095; A47L 23/06; B24B 23/04; B24B 29/00
See application file for complete search history.

(56) References Cited

U.S. PATENT DOCUMENTS 2,912,706 A 11/1959 Gerecke et al.
3,517,235 A * 6/1970 Godel ..... A46B 13/02 15/22.1
(Continued)

FOREIGN PATENT DOCUMENTS

DE 2632584 A1 1/1978
EP 1166963 A1 1/2002
(Continued)

OTHER PUBLICATIONS

International Search Report dated Jan. 29, 2015 for corresponding International Application No. PCT/GB2014/000446, filed Nov. 5, 2014.
(Continued)

*Primary Examiner* — Randall E Chin
(74) *Attorney, Agent, or Firm* — David D. Brush; Westman, Champlin & Koehler, P.A.

(57) ABSTRACT

A portable system for imparting a reciprocating motion between a driving member and a driven member. The driving member has an upper and lower surfaces joined by one or more edges and includes a battery-powered drive mechanism. The driven member includes a treatment surface. First and second spaced apart studs extend from one of the members, and first and second spaced apart slots are formed in the other member. A locating recess is formed in each of the slots into which the studs are received. The drive mechanism is connected to one of the studs to impart a linear reciprocating motion thereto when the driven member is attached to the driving member. The connection between the driving member and the driven member is effected by each stud being entered into the respective slot and then moved into the respective locating recess by a twist-fit action.

19 Claims, 9 Drawing Sheets

(51) Int. Cl.

| | |
|---|---|
| ***B24B 23/04*** | (2006.01) |
| ***B24B 29/00*** | (2006.01) |
| ***B24B 47/04*** | (2006.01) |
| ***A46B 5/00*** | (2006.01) |

(52) U.S. Cl.
CPC ..... *B24B 29/00* (2013.01); *B24B 47/04* (2013.01); *A46B 2200/306* (2013.01)

(56) References Cited

U.S. PATENT DOCUMENTS

| | | | | |
|---|---|---|---|---|
| 3,842,549 | A | 10/1974 | Johnston | |
| 5,597,347 | A | 1/1997 | Bosten et al. | |
| 5,706,541 | A * | 1/1998 | Gutelius ..... | A46B 13/02 15/22.1 |
| 2006/0101597 | A1 | 5/2006 | Donnelly | |
| 2006/0179590 | A1 * | 8/2006 | Spooner ..... | A46B 7/04 15/22.2 |
| 2008/0254721 | A1 | 10/2008 | Wuensch | |

FOREIGN PATENT DOCUMENTS

| | | | |
|---|---|---|---|
| JP | 2011139873 | A | 7/2011 |
| WO | 2005108010 | A1 | 11/2005 |

OTHER PUBLICATIONS

UKIPO Search Report dated Feb. 3, 2014 for corresponding GB Application No. 1319594.6, filed Nov. 6, 2013.
Written Opinion of the International Searching Authority dated Jan. 29, 2015 for corresponding International Application No. PCT/GB2014/000446, filed Nov. 5, 2014.

* cited by examiner

LINEAR RECIPROCATING DEVICE

CROSS-REFERENCE TO RELATED APPLICATIONS

The present application is a continuation-in-part of and claims priority from PCT/GB2014/000446, filed Nov. 5, 2014, which claims priority of Great Britain Application GB1319594.6, filed Nov. 6, 2013, the contents of which are hereby incorporated by reference in their entireties.

FIELD OF THE INVENTION

This invention relates to a linear reciprocating device, particularly a hand-held one which can form part of a shoe-shine brush system, for example.

BACKGROUND OF THE INVENTION

Shoe shining may be performed manually, or using a powered device.

Many people prefer their shoes to be manually polished using a compact brush as this tends to give a better result and allows all areas of the shoe to be covered. However, it can be tiring and/or expensive if using a shoe-shine service on a regular basis. On the other hand, powered devices typically consist of a large mains-powered machine that rotates in one direction. The device is not portable and requires mains power. Further, the device does not mimic the usual back and forth linear motion that manual brushing gives and cannot reach all areas.

Similarly, other applications such as wood sanding tend to achieve more desirable and accurate finishes with a portable reciprocating unit rather than a large rotating unit.

SUMMARY OF THE INVENTION

A first aspect of the invention provides a portable system for imparting a reciprocating motion comprising:

a driving member having an upper surface and a lower surface joined by one or more edges, a battery-powered drive mechanism, and first and second connector studs extending from the lower surface at spaced apart positions, one of the studs being connected to the drive mechanism which is configured to move said stud back and forth in a linear reciprocating manner; and a removable attachment comprising a body having on one surface a treatment surface and on an opposite surface first and second slots each extending inwards from a slot opening on opposite lateral edges of said body towards respective locating recesses, the spacing between the respective locating recesses corresponding approximately to the spacing between the connector studs of the driving member, wherein, in use, connection of the attachment to the main body is effected by means of the studs being entered within a respective slot opening in the opposite lateral edges and then moved into the respective locating recesses by means of a twist-fit action.

In another aspect the invention provides a portable system for imparting a reciprocating motion between a driving member and a driven member, said driving member having an upper surface and a lower surface joined by one or more edges and including a battery-powered drive mechanism, and said driven member comprising a body having on one surface a treatment surface or means for carrying a treatment surface, said system further comprising first and second spaced apart studs extending from a surface of one said member and first and second spaced apart slots formed in a surface of the other said member, a locating recess formed in each of said slots into which the studs are, in operation of the system, received, and means for connecting said drive mechanism to one of the said studs to impart a linear reciprocating motion thereto when said driven member is attached to said driving member, wherein, in use, connection between the driving member and the driven member is effected by each stud being entered into the respective slot and then moved into the respective locating recess by means of a twist-fit action.

The portable system may be a shoe brush system, wherein the removable attachment is a brush head and the treatment surface carries a set of bristles. Alternatively, the removable attachment may carry a polishing or sanding surface, for example. The treatment surface could also be detachable from the removable attachment allowing interchangeable finishing surfaces.

Each stud may comprise a stem portion and a wider boss portion at or near its free end, each slot opening on the attachment being sufficiently wide enough to allow the boss part to enter the slot and locate underneath an overhanging edge or edges of the slot and of the locating recess. One of the locating recesses may be elongate.

The drive mechanism may comprise a crank to which is pivotally connected a rod which is connected to an arm mechanically constrained to move in a linear reciprocating manner and to which the stud is connected.

Both connector studs may be connected to the drive mechanism such as to move back and forth in synchronisation.

Both locating recesses of the attachment may be elongate.

The drive mechanism may comprise a crank to which is pivotally connected first and second rods, which extend in generally opposite directions and which are connected to respective first and second arms mechanically constrained to move in a linear reciprocating manner and to which the first and second studs are respectively connected.

A damping member may be positioned around each of the studs.

A further aspect provides a removable attachment for use with a system according to any preceding definition.

A still further aspect provides a brush head and a drive member selectively connectable to the brush head for imparting reciprocating movement thereto, the brush head including first and second slots which extend inwardly from opposite sides of its periphery to positions inboard of that periphery, each slot including a lower channel and an upper channel of less width than that of the lower channel with the first slot terminating in a similarly shaped third slot which extends generally normal to said first slot, and the drive member including first and second upstanding studs each having a neck of width less than that of the lower and upper channels of each slot and a head of width greater than the width of the upper channel of each slot, and means operable to impart reciprocating motion to said first stud of the drive member, the arrangement being such that, in use, the said first stud is inserted into the open end of said second slot and the second stud is inserted into the open end of the first slot with the studs then being moved through the respective slots by imparting a relative turning motion between the brush head and the drive member whereby the second stud is enabled to enter said third slot and to reciprocate therein upon reciprocation of the first stud.

A yet further aspect provides a brush head and a drive member selectively connectable to the brush head for imparting reciprocating movement thereto, the drive member including an upper surface in which are formed first and second slots, each slot including a lower channel and an upper channel, and an opening of greater width than that of the upper channel, and said brush head including first and second upstanding studs each having a neck of width less than that of the lower and upper channels of each slot and a head of width greater than the width of the upper channel of each slot, and means operable to impart reciprocating motion to said first stud of the brush head, the arrangement being such that, in use, the said first and second studs are inserted into said openings of greater width of said first and second slots with the studs then being moved through the respective slots by imparting a relative turning motion between the drive member and the brush head, whereby at least one stud is connected to said means operable to impart reciprocating motion to said first stud of the brush head.

BRIEF DESCRIPTION OF THE DRAWINGS

The invention will now be described, by way of non-limiting example, with reference to the accompanying drawings, in which.

DETAILED DESCRIPTION OF PREFERRED EMBODIMENTS

Figure 1:
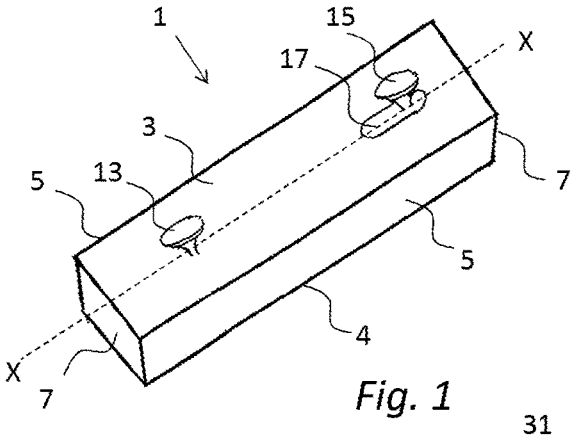
FIG. 1 is a perspective view of a drive member for a shoe brush in accordance with the invention.

Referring to FIG. 1, a drive member 1 for a portable shoe brush system is shown. The drive member 1 comprises a body that in this example is a rectangular cuboid having a mounting surface 3, an opposite surface 4, opposed side surfaces 5, and opposed end surfaces 7. The drive member 1 contains circuitry and a mechanism to be described below.

Projecting from the mounting surface 3 are first and second studs 13, 15 which are aligned along a substantially central longitudinal axis X-X and spaced apart as shown. The first stud 13 is fixed in position on the mounting surface 3. The second stud 15, hereafter referred to as the drive stud, is connected to a drive mechanism (not shown) located within the body which mechanism is effective when operated to move the drive stud back and forth along axis X-X in a reciprocating motion. A slot 17 is provided to permit this linear motion.

The shape of each stud 13, 15 is substantially identical (other than the fact that the drive stud extends into the body) and comprises a narrow stem or shaft portion and a larger boss portion which is oval or circular in plan view.

Figure 2:
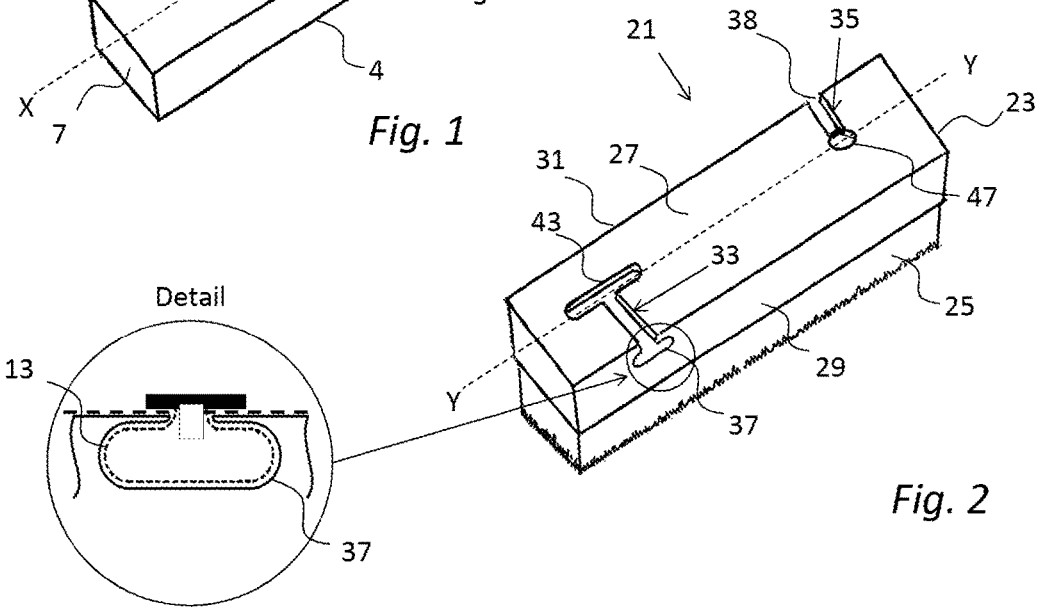
FIG. 2 is a perspective view of a brush head attachment for connection to the drive member of FIG. 1 in accordance with the invention.

Referring now to FIG. 2, a removable brush head 21 for selective attachment to the drive member 1 is shown. The brush head 21 in this case is similar in shape and form to that of the drive member 1 in that it comprises a rectangular cuboid body 23, with a central longitudinal axis Y-Y. Said body 23 comprises a lower surface which carries brush bristles 25. The opposite, upper surface 27 is a mounting surface for engagement with the like-named surface 3 of the drive member 1. There are also opposed side surfaces 29, 31 and end surfaces which connect the main surfaces as indicated.

Two mounting slots, generally indicated 33, 35, are recessed into the body 23 from the sides 29, 31. Each slot 33, 35 comprises an opening portion 37, 38 formed in the opposite side walls 39, 31 and spaced apart longitudinally by a distance which is approximately the same as the distance between the two studs 13, 15 when viewed longitudinally or from above.

The slots 33, 35 extend inwardly, towards (and generally transverse to) the central axis Y-Y and terminate at a respective mounting recess 43, 47 positioned on Y-Y. Mounting recess 43 is elongated along axis Y-Y for reasons that will become clear.

The opening portions 37, 38 are dimensioned to be wider than the diameter of the boss of each of the first and second studs 13, 15. The upper part of each channel, where they meet the upper surface 27, is however narrower than said boss diameter and wider than the stem diameter of each stud 13, 15 (see detailed part of Figure).

To connect the brush head 21 to the drive member 1, the user locates the fixed stud 13 adjacent the opening 37 of the first mounting slot 33 and at the same time the drive stud 15 adjacent the opening 38 of the second mounting slot 35. The brush head 21 and drive member 1 are therefore at an angle to one another. A relative rotation or twist action is then used to locate the studs 13, 15 through the slots 33, 35 into their respective mounting recess 43, 47. The brush head 21 and drive member 1 are then connected together with X-X and Y-Y substantially aligned.

The drive member 1 is operated by user action to impart a reciprocating linear motion to the drive stud 15. This in turn imparts movement to the brush head 21 via its engagement with mounting recess 47. The elongate mounting recess 43 permits reciprocating travel of the brush head 1 along axis Y-Y with the fixed stud 13 maintaining alignment and preventing lateral movement. This is because the diameter of the stem portion is substantially the same as the width of the slot 43.

In this twist-type fitment, mounting and un-mounting of a brush head can be done quickly and easily. However, in general use of the system, the reciprocating linear motion will not inadvertently cause the brush head to become disconnected because only the reverse twisting motion can achieve this.

Figure 3:
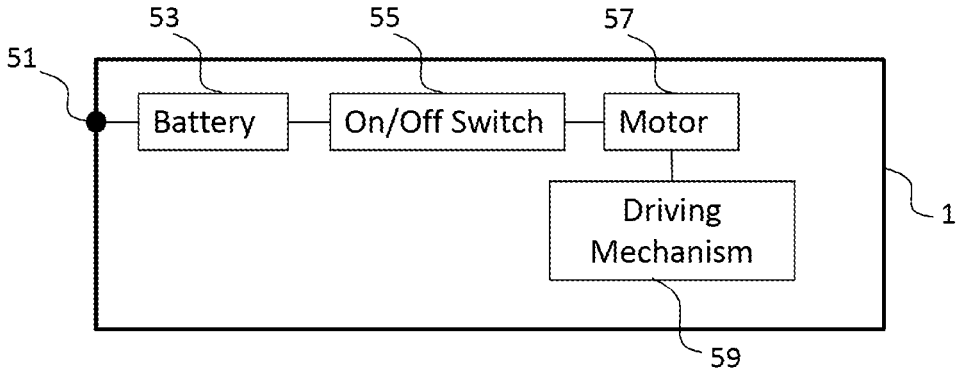
FIG. 3 is a block diagram showing functional modules within the drive member of FIG. 1.

FIG. 3 shows the main functional modules contained within the drive member 1. A recharging port 51 is accessible on the body to permit charging of one or more batteries 53 housed therewithin. Said port 51 is not required if non-rechargeable batteries are used. A user-operable on/off switch 55 is disposed between the battery output and a motor 57 which, when activated, imparts rotational motion to a driving mechanism 59.

Figure 4:
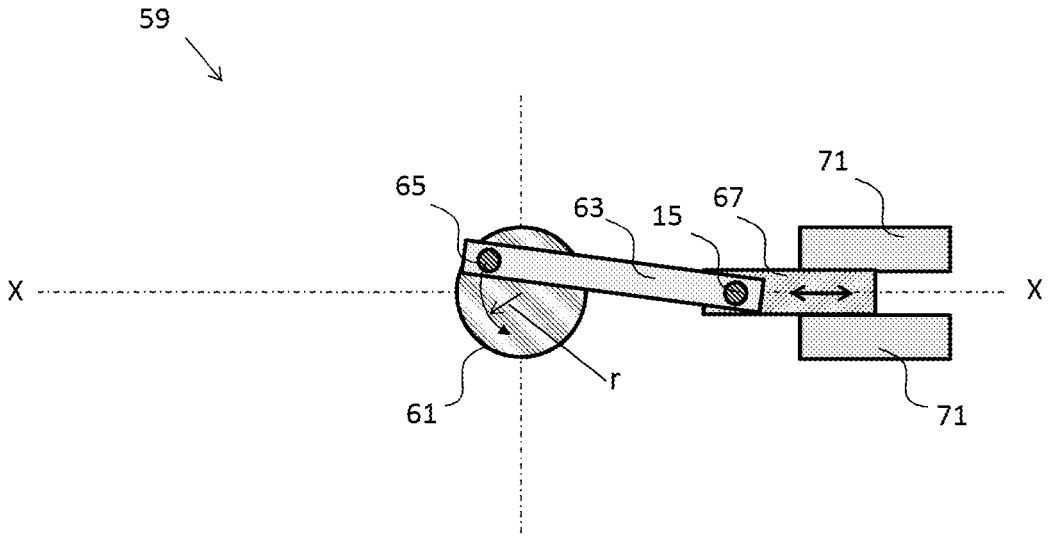
FIG. 4 is a plan view of a drive mechanism for use in the drive member of FIG. 1.

FIG. 4 shows an example driving mechanism 59 suitable for use in the first embodiment shown in FIGS. 1 and 2.

Referring to FIG. 4, the driving mechanism 59 comprises a crank 61 driven in a clockwise direction by the motor 57 (not shown). The crank 61 is centred along axis X-X. A connecting rod 63 is connected to the periphery of the crank by a pivot 65. The elongate connecting rod 63 is pivotally connected to a drive shaft 67 which is constrained to move back and forth along axis X-X by retaining members 71 either side. The drive stud 15 is located on the drive shaft 67 and hence moves back and forth in the required reciprocating manner.

A downside with this driving mechanism 59 is that it is asymmetric and hence balancing may be required to reduce or prevent vibration when the mechanism is operating. Nevertheless, the resulting motion imparted on the brush gives desirable results in a compact and portable unit.

A further embodiment of a drive member 72 and brush head 73 will now be described with reference to FIGS. 5 and 6.

Figure 5:
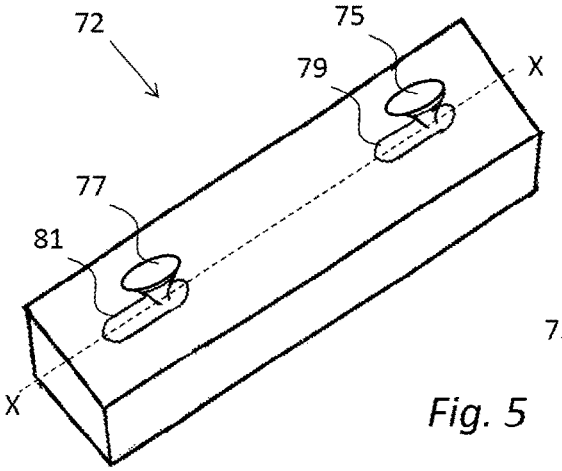
FIG. 5 is a perspective view of a second embodiment drive member in accordance with the invention.

Referring to FIG. 5, the drive member 72 is similar to that shown in FIG. 1, but in this case comprises two drive studs 75, 77 both of which are connected to the driving mechanism and both move in a reciprocating manner in sympathy with each other. Drive slots 79, 81 are provided for this purpose. An exemplary drive mechanism will be described later on with reference to FIG. 7.

Figure 6:
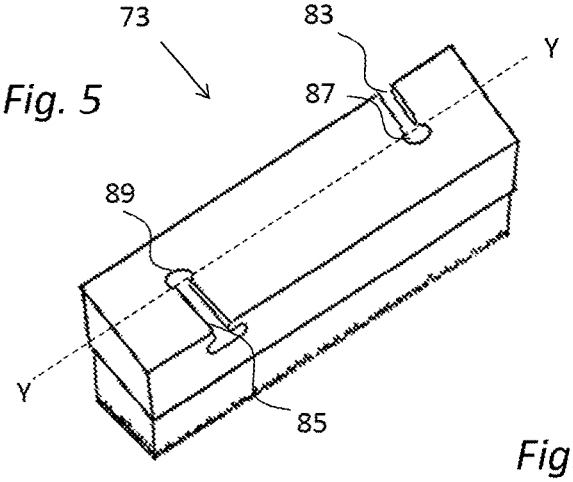
FIG. 6 is a perspective view of a second embodiment brush head attachment for connection to the drive member of FIG. 5 in accordance with the invention.

Referring to FIG. 6, the brush head 73 is similar to that shown in FIG. 2, but in this case both mounting recesses 87, are generally circular, as is the case for recess 35 in FIG. 2. These recesses could be elongate, however.

Attachment and detachment of the brush head 73 to the drive member 71 involves the same twist motion described previously and the relative dimensions of the slot openings, the mounting recess widths and the stud diameters are likewise the same or similar to prevent significant lateral movement.

Figure 7:
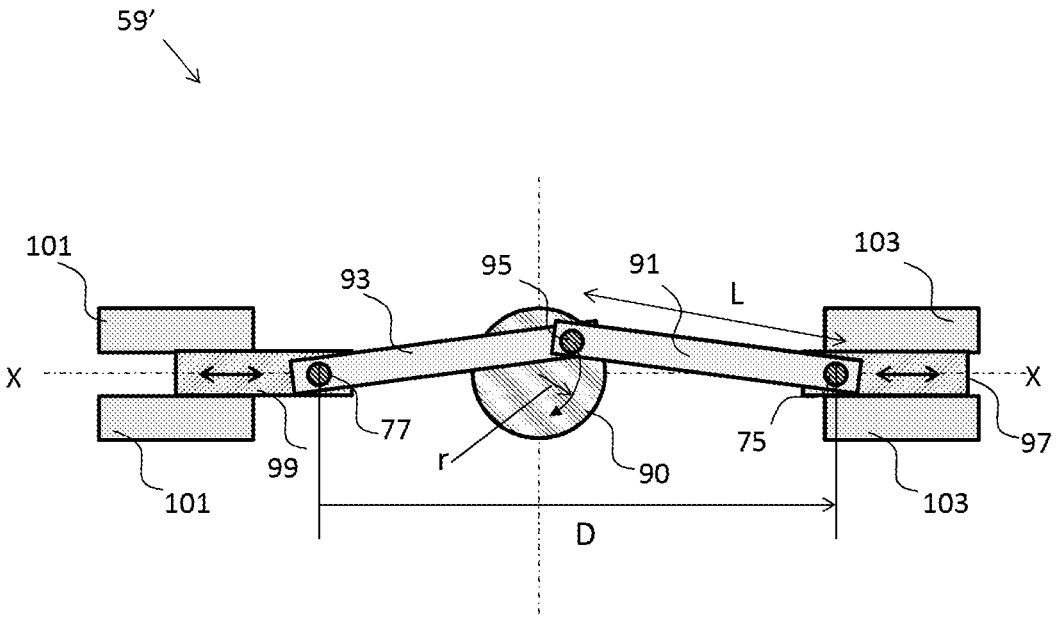
FIG. 7 is a plan view of a drive mechanism for use in the drive member of FIG. 5.

A suitable driving mechanism 59' is shown in FIG. 7. The driving mechanism 59' comprises a single crank 90 driven by the motor 57 (not shown). The crank 90 is centred along axis X-X. First and second connecting rods 91, 93 are connected at the same point to the periphery of the crank 90 by a pivot 95. The elongate connecting rods 91, 93 extend in opposite directions and are pivotally connected to respective drive shafts 97, 99 each of which is constrained to move back and forth along axis X-X by restraining members 101, 103 either side. The drive studs 75, 77 are located on the drive shafts 91, 93 and hence move back and forth in the required reciprocating manner.

Referring to the dimensions indicated in the Figure, it will be appreciated that:

$$D=2\sqrt{L^2-r^2\cos(\alpha)^2}$$

Meaning that the minimum distance between reciprocating studs is $2\sqrt{L^2-r^2}$ and the maximum distance between reciprocating studs is $2L^2$. For this reason, the mounting recesses 87, 89 may have a slightly larger circumference or could be elongate than the studs 75, 77 to cater for the variation.

This driving mechanism 59' is symmetric in design, but suffers from a variation in the distance between the driving studs 75, 77. Issues of noise and wear that may result can be reduced or avoided using damping, e.g. rubber bushes around the studs 75, 77.

Figures 8A, 8B, 8C:
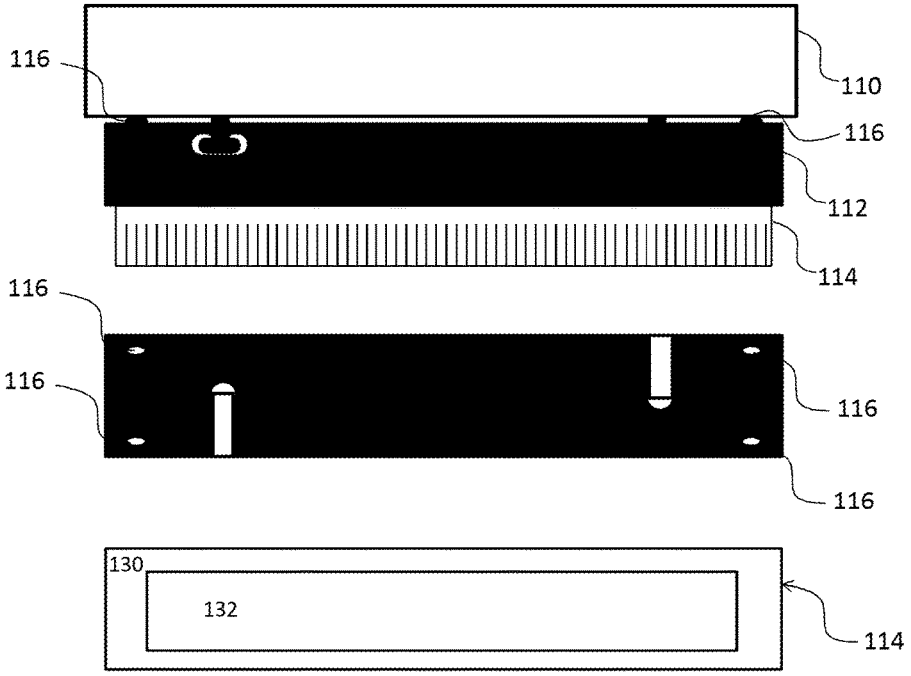
FIG. 8A is a side view of components of a third embodiment shoe brush.
FIG. 8B is a top plan view of a brush head component of the FIG. 8A shoe brush.
FIG. 8C is a bottom plan view of the brush head component of the FIG. 8A shoe brush.

Referring now to FIG. 8A, a third embodiment shoe brush is shown, comprising a drive member 110, and brush head 112 which carries a set of bristles 114 on its lower side. The drive member 110 and brush head 112 are similar to those of the second embodiment, but comprise four domed protrusions 116 provided at the corner regions of the brush head 112, and correspondingly-positioned recessed dimples on the drive member 110. It will be appreciated that, when the drive member 110 and brush head 112 are connected, the protrusions 116 locate partially within the dimples and help prevent twisting in use. Alternatively the protrusions 116 can be on the brush head 112 and the dimples on the drive member 110.

Further, referring to FIG. 8C, the bristles 114 are arranged in plan view such that the outer perimeter 130 has a longer pile, by approximately 2 mm, than the bristles in the central region 132. This has the effect of preventing a spray-like mist of polish during operation. This arrangement of bristles 114 could be applied in the first and second embodiments also.

Figure 9:
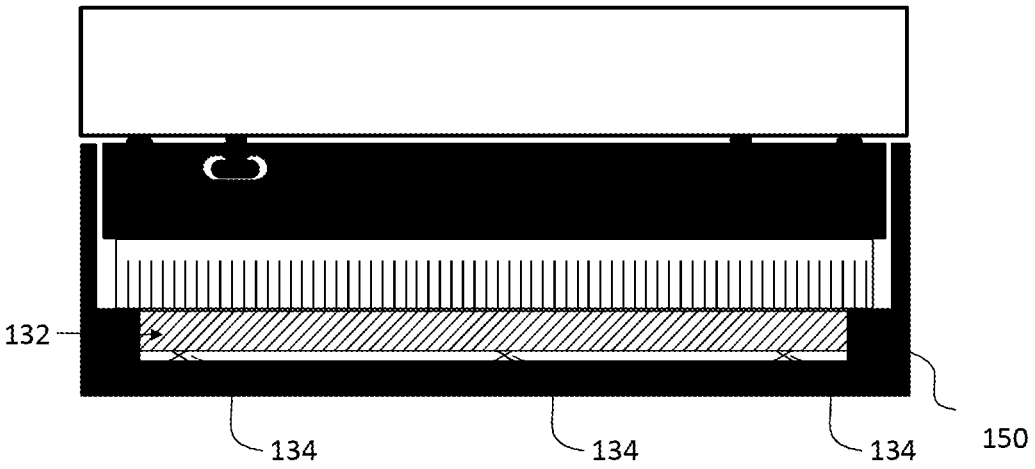
FIG. 9 is a side sectional view of the third embodiment shoe brush located within a caddy.

Referring to FIG. 9, the third embodiment shoe brush is shown located within a case or caddy 150, with the drive member 110 resting on the upper perimeter edge of the caddy, and the brush head 112 and bristles 114 located inside the walls of said caddy. A rectangular recess 140 is provided in the base wall of the caddy 150 within which is provided a layer of polish 132 mounted on a springy base (see the springs 134, which can be of any suitable form) which urges the polish layer upwards. In this way, when the shoe brush is mounted within the caddy 150, the polish 132 is in contact with the lower ends of the bristles 114 for application. To apply the polish to the brush, therefore, the drive member 110 is activated, preferably at relatively low speed, and as the bristles reciprocate gently, polish is applied thereto.

A similar caddy arrangement can be used with the first and second embodiments also.

Figure 10:
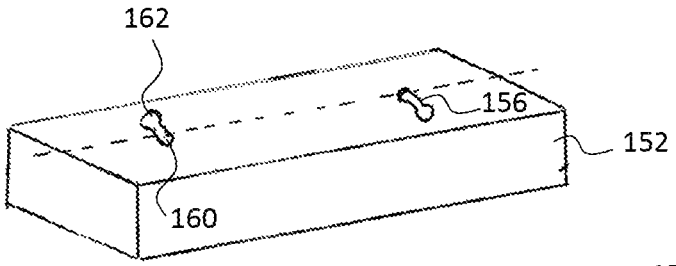
FIG. 10 is a perspective view of a fourth embodiment drive member for a shoe brush in accordance with the invention.
Figure 11:
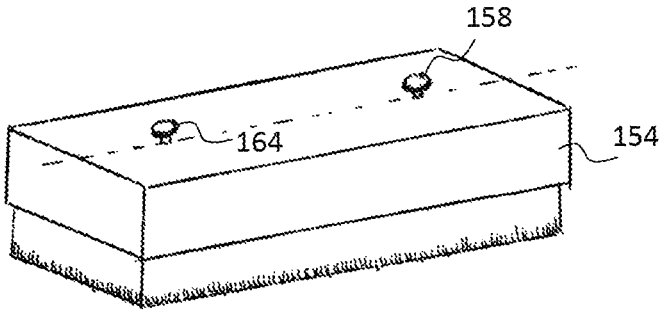
FIG. 11 is a perspective view a fourth embodiment brush head for connection to the drive member illustrated in FIG. 10.
Figure 12:
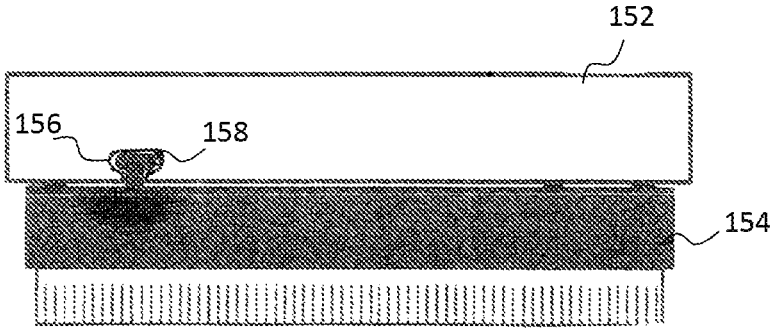
FIG. 12 is a schematic side view in section showing the drive member and shoe brush of the fourth embodiment attached.

A still further embodiment of a drive member 152 and brush head 154 will now be described with reference to FIGS. 10 to 12.

The drive member 152 is similar to those shown in FIGS. 1 and 5 and the brush head 154 is similar to those shown in FIGS. 2 and 6 except that in this embodiment the drive member 152 is formed with two recesses 156 and the brush head has two drive studs 158 upstanding from its upper surface. In other respects, the drive member 152 and the brush head 154 replicate the features of the drive member 3 and the brush head 27 of FIGS. 1 and 2, or the features of the drive member 72 and brush head 73 of FIGS. 5 and 6.

Each recess 156 is curvilinear and includes a locating recess 160 and a wider entry recess 162 into which the heads 164 of the drive studs 158 are received. Thus when assembling the brush head to the drive member the studs 158 are initially located in the entry recesses 162 of the recesses 156 and the brush member is then moved to locate the drive studs 158 within the locating recesses 160 to place the drive studs in communication with the battery powered drive mechanism located within the drive member. The battery powered drive mechanism is substantially the same as that shown in FIG. 4 or FIG. 7.

It will be appreciated from the above that an improved portable shoe brush system can be provided comprising a driving member and one or more removable brush heads. The reciprocating motion permits in a portable system the mimicking of the manual polishing process that can access even hard-to-reach parts of a shoe. Different brush heads can be provided for different purposes, e.g. one for initial brushing and one for fine polishing. The brush heads can be easily replaced if necessary.

References herein to "shoe" are intended to cover obvious alternatives including any type of footwear. References to "stud" include obvious alternatives such as pegs or indeed any protruding member.

Further, other applications for the drive member and slotted (twist-action) attachment system can be used. For example, a brush for cleaning in general, or a work tool that requires a back and forth motion, e.g. wood sanding.

It will be appreciated that the above described embodiments are purely illustrative and are not limiting on the scope of the invention. Other variations and modifications will be apparent to persons skilled in the art upon reading the present application.

Moreover, the disclosure of the present application should be understood to include any novel features or any novel combination of features either explicitly or implicitly disclosed herein or any generalization thereof and during the prosecution of the present application or of any application derived therefrom, new claims may be formulated to cover any such features and/or combination of such features.

The invention claimed is:

1. A portable system for imparting a reciprocating motion comprising:

a driving member having an upper surface and a lower surface joined by one or more edges, a battery-powered drive mechanism, and first and second connector studs extending from the lower surface at spaced apart positions, one of the studs being connected to the drive mechanism which is configured to move said stud back and forth in a linear reciprocating manner; and a removable attachment comprising a body having on one surface a treatment surface or means for carrying a treatment surface and on an opposite surface first and second slots each extending inwards from a slot opening on opposite lateral edges of said body towards respective locating recesses, the spacing between the respective locating recesses corresponding approximately to the spacing between the connector studs of the driving member, wherein, in use, connection of the attachment to the driving member is effected by means of the studs being entered within a respective slot opening in the opposite lateral edges and then moved into the respective locating recesses by means of a twist-fit action.

2. A portable system according to claim 1, being a shoe brush system, wherein the removable attachment is a brush head and the treatment surface carries a set of bristles.

3. The system of claim 1, wherein each stud comprises a stem portion and a wider boss portion at or near its free end, each slot opening on the attachment being sufficiently wide enough to allow the boss part to enter the slot and locate underneath an overhanging edge or edges of the slot and of the locating recess.

4. The system of claim 1, wherein one of the locating recesses is elongate.

5. The system of claim 1, wherein the drive mechanism comprises a crank to which is pivotally connected a rod which is connected to an arm mechanically constrained to move in a linear reciprocating manner and to which the stud is connected.

6. A system according to claim 1, wherein both connector studs are connected to the drive mechanism such as to move back and forth in synchronisation.

7. A system according to claim 6, wherein both locating recesses of the attachment are elongate.

8. A system according to claim 6, wherein the drive mechanism comprises a crank to which is pivotally connected first and second rods which extend in generally opposite directions and which are connected to respective first and second arms mechanically constrained to move in a linear reciprocating manner and to which the first and second studs are respectively connected.

9. A system according to claim 8, wherein a damping member is positioned around each of the studs.

10. A portable system for imparting a reciprocating motion between a driving member and a driven member, said driving member having an upper surface and a lower surface joined by one or more edges and including a battery-powered drive mechanism, and said driven member comprising a body having on one surface a treatment surface or a receiving mechanism for receiving attachment of a treatment surface, said system further comprising first and second spaced apart studs extending from a surface of one said member and first and second spaced apart slots formed in a surface of the other said member, a locating recess formed in each of said slots into which the studs are, in operation of the system, received, and a connecting mechanism for connecting said drive mechanism to one of the said studs to impart a linear reciprocating motion thereto when said driven member is attached to said driving member, wherein, in use, connection between the driving member and the driven member is effected by each stud being entered into the respective slot and then moved into the respective locating recess by means of a twist-fit action.

11. A portable system according to claim 10, being a shoe brush system, wherein the driven member is a brush head and the treatment surface carries a set of bristles.

12. A system according to claim 11, wherein the bristles are arranged such that the bristles of an outer, perimeter region are longer than those inside the perimeter region.

13. The system of claim 10, wherein each stud comprises a stem portion and a wider boss portion at or near its free end, each slot opening on the attachment being sufficiently wide enough to allow the boss part to enter the slot and locate underneath an overhanging edge or edges of the slot and of the locating recess.

14. The system of claim 10, wherein one of the locating recesses is elongate.

15. The system of claim 10, wherein the drive mechanism comprises a crank to which is pivotally connected a rod which is connected to an arm mechanically constrained to move in a linear reciprocating manner and to which the stud is connected.

16. A system according to claim 10, wherein both studs are connected to the drive mechanism such as to move back and forth in synchronisation.

17. A system according to claim 16, wherein the drive mechanism comprises a crank to which is pivotally connected first and second rods which extend in generally opposite directions and which are connected to respective first and second arms mechanically constrained to move in a linear reciprocating manner and to which the first and second studs are respectively connected.

18. A system according to claim 17, wherein a damping member is positioned around each of the studs.

19. A system according to claim 10, wherein both locating recesses of the attachment are elongate.

* * * * *